US010717020B2

(12) United States Patent
Schramm

(10) Patent No.: US 10,717,020 B2
(45) Date of Patent: Jul. 21, 2020

(54) SPILL RESISTANT CONTAINER AND METHOD OF MANUFACTURE

(76) Inventor: Michael R. Schramm, Perry, UT (US)

( * ) Notice: Subject to any disclaimer, the term of this patent is extended or adjusted under 35 U.S.C. 154(b) by 1923 days.

(21) Appl. No.: 13/234,265

(22) Filed: Sep. 16, 2011

(65) Prior Publication Data

US 2015/0246294 A1 Sep. 3, 2015

Related U.S. Application Data

(60) Provisional application No. 61/383,399, filed on Sep. 16, 2010.

(51) Int. Cl.
*A63H 33/28* (2006.01)

(52) U.S. Cl.
CPC ..... *A63H 33/28* (2013.01)

(58) Field of Classification Search
CPC ..... A63H 33/28
USPC ..... 220/719, 709, 705, 359.1, 694, 735; 215/229, 228, 41; 141/98, 311 A, 333, 141/339, 331; 446/15–21; 401/122
See application file for complete search history.

(56) References Cited

U.S. PATENT DOCUMENTS 2,858,639 A 11/1958 Lawrence
3,579,898 A * 5/1971 Hein ..... A47K 5/122 446/16
3,781,164 A * 12/1973 McCaffery ..... F21V 35/00 431/291
4,180,938 A 1/1980 LaFata ..... 46/6
4,257,185 A * 3/1981 Tomson ..... A63H 33/28 40/408
4,301,841 A * 11/1981 Sandow ..... B65D 23/10 141/326
4,840,597 A * 6/1989 Perez ..... A63H 3/24 220/719
4,957,464 A 9/1990 Perez ..... 446/16
5,022,559 A * 6/1991 Condon ..... B44D 3/121 15/104.94
5,088,950 A 2/1992 LaFata ..... 446/19
5,105,975 A 4/1992 Patterson ..... 220/709
5,246,046 A 9/1993 Schramm ..... 141/98
5,304,085 A 4/1994 Novak ..... 446/15
5,341,948 A * 8/1994 Gaeta ..... 215/232
5,495,876 A 3/1996 Schramm ..... 141/98
(Continued)

FOREIGN PATENT DOCUMENTS

EP 0094532 11/1983

OTHER PUBLICATIONS

Hasbro, Inc., Spill Resist Cap, Date=Circa 1999, p. 1.
(Continued)

*Primary Examiner* — Kareen K Thomas
(74) *Attorney, Agent, or Firm* — Michael R. Schramm

(57) ABSTRACT

The present invention is a spill resistant container apparatus that eliminates the need for pouring of liquid such as bubble solution into or out of the spill resistant container apparatus in order to use the spill resistant container apparatus. The apparatus, which is preferably provided with bubble solution sealingly contained within the apparatus, will, when opened, prohibit the pouring of liquid out of the apparatus regardless of the physical orientation of the apparatus. The apparatus is preferably of such low cost construction that the apparatus is readily disposable after the bubble solution contained within the apparatus is substantially consumed.

39 Claims, 8 Drawing Sheets

(56) References Cited

U.S. PATENT DOCUMENTS

| | | | | |
|---|---|---|---|---|
| 5,832,969 | A | 11/1998 | Schramm | 141/98 |
| RE36,131 | E | 3/1999 | Schramm | 141/98 |
| 5,908,057 | A | 6/1999 | Schramm | 141/98 |
| 6,015,327 | A | 1/2000 | Kovacs | 446/15 |
| 6,135,842 | A * | 10/2000 | LaFata | 446/15 |
| 6,186,853 | B1 | 2/2001 | Messina | 446/15 |
| 6,386,138 | B1 | 5/2002 | Schramm | 118/26 |
| 6,520,822 | B2 | 2/2003 | Kennedy | 446/15 |
| 6,595,822 | B1 * | 7/2003 | Thai | A63H 33/28 446/16 |
| 6,629,870 | B2 | 10/2003 | Robinson | 446/16 |
| 6,638,131 | B1 | 10/2003 | Thai | 446/15 |
| 6,857,928 | B2 | 2/2005 | Thai | 446/15 |
| RE39,443 | E | 12/2006 | Schramm | 141/98 |
| 7,169,007 | B1 * | 1/2007 | Kennedy | 446/15 |
| 7,244,161 | B2 | 7/2007 | Thai | 446/15 |
| 7,524,230 | B2 | 4/2009 | Thai | 446/15 |
| 7,942,109 | B2 | 5/2011 | Schramm | 118/13 |
| RE42,610 | E | 8/2011 | Schramm | 141/98 |
| 2001/0035413 | A1 | 11/2001 | Thai | 220/213 |
| 2002/0129763 | A1 | 9/2002 | Schramm | 118/13 |
| 2002/0187716 | A1 | 12/2002 | Kennedy | 446/15 |
| 2003/0155364 | A1 | 8/2003 | Thai | 220/714 |
| 2004/0084453 | A1 | 5/2004 | Thai | 220/259.1 |
| 2005/0130552 | A1 | 6/2005 | Thai | 446/74 |
| 2008/0289975 | A1 | 11/2008 | Sharber | 206/207 |
| 2011/0081821 | A1 | 4/2011 | Temiz | 446/16 |

OTHER PUBLICATIONS

Hasbro, Inc., No Spill Mr. Potato Head, Date=Circa 1999, p. 1.
Toy Originators, Inc., Bubble Brush, Date=Circa 1992, p. 1.
Toy Originators, Inc., Spill Resist Cap, Date=Circa 1992, pp. 1-3.
Tak-A-Toy, Popeye Bubble Factory, Date=Circa 1992, p. 1.
Remco, Inc., Bubble Blowing Glider, Date=Circa 1992, p. 1.
Little Kids, Inc., No-Spill Bubble Tumbler, Date=Circa 1993, p. 1.
Little Kids, Inc., No-Spill Bubble Tumbler Minis, Date=Circa 1998, p. 1.
Little Kids, Inc., No-Spill Bubble Tumbler Micro Minis, Date=Circa 2004, p. 1.
Little Kids, Inc., No-Spill Big Bubble Bucket, Date=circa 1996, p. 1.
Little Kids, Inc., No-Spill Mini Bubble Bucket, Date=circa 2002, p. 1.
Little Kids, Inc., No-Bubble Mug, Date=circa 1996, p. 1.
Little Kids, Inc., No-Spill Bubble Holster, Date=circa 2007, p. 1.
Little Kids, Inc., No-Spill Motorized Dip 'N Blow Bubbles, Date=2009, p. 1.
Little Kids, Inc., No-Spill Bubble Dooods, Date=2009, p. 1.
Strombecker, Inc., Mr. Bubbles Spill Proof Bubble Toy, Date=1995, p. 1.
Strombecker, Inc., Spill Proof Bubble Rocket, Date=1995, p. 1.
Strombecker, Inc., Spill Proof Elmo's Bubble Fun, Date=circa 1997, p. 1.
Strombecker, Inc., Spill Proof Marvin the Martian Bubble Spaceship, Date=circa 1999, p. 1.
Strombecker, Inc., Spill Proof Hunny Pot, Date=circa 1999, p. 1.
Strombecker, Inc., Spill Proof Tweety Bubble Necklace, Date=circa 1997, p. 1.
Strombecker, Inc., Spill Proof Container with Aux Handle, Date=circa 2000, p. 1.
Strombecker, Inc., Mini Spill Proof, Date=circa 2002, p. 1.
Imperial Toy, Inc., No Spill Miracle Bubbles, Date=circa 1996, p. 1.
Imperial Toy, Inc., No-Spill Bubble Submarine, Date=circa 1998, p. 1.
Imperial Toy, Inc., No-Spill Bubble Cell Phone, Date=circa 1998, p. 1.
Imperial Toy, Inc., No Tip No Spill Bubble Tumbler, Date=circa 2001, p. 1.
Imperial Toy, Inc., No-Spill Bubbles 'N Sand Bucket, Date=circa 1999, p. 1.
Imperial Toy, Inc., Spill Stopper, Date=circa 2010, p. 1.
Little Tykes, Inc., No Spill Bubble Buddy, Date=circa 2001, p. 1.
Little Tykes, Inc., No Spill Bubble Bucket, Date=circa 2001, p. 1.
Placo, Inc., Super Non-Spill Double Tumbler, Date=circa 2000, p. 1.
Placo, Inc., Pivot Top Spill Resistant Bubbles, Date=circa 2002, p. 1.
Placo, Inc., Spill Resistant Giant Bucket, Date=circa 2004, p. 1.
Placo, Inc., Spill Resistant Mini Bucket, Date=circa 2004, p. 1.
Tangent/ToySmith, Inc., Never Spill Resistant Bubbles, Date=circa 2002, p. 1.
Battat, Inc., Non Spill Bubble tumbler, Date=circa 1996, p. 1.
Flair/Funrise, Inc., No Spill Tumbler, Date=circa 2002, p. 1.
Funrise, Inc., Non Spill Bubble Bouncer, Date=circa 2002, p. 1.
Funrise, Inc., Bubble Wubble Tumbler, Date=2009, p. 1.
Koosh/Oddzon, Inc., Weeble Wobble Bubble Bottle, Date=circa 1999, p. 1.
Toys R Us, Inc., No-Spill Bubble Canteen, Date=circa 1996, p. 1.
Toy Quest, Inc., Barbie Baubles 'N bubbles Bubble Purse, Date=circa 2009, p. 1.
Pustefix, Inc., No Spill Bubble Bucket, Date=Circa 2011, p. 1.

* cited by examiner

SPILL RESISTANT CONTAINER AND METHOD OF MANUFACTURE

CROSS REFERENCE TO RELATED APPLICATIONS

This nonprovisional utility patent application claims the benefit under 35 U.S.C. § 119(e) of U.S. provisional application No. 61/383,399, filed Sep. 16, 2010, which is incorporated, in its entirety, by this reference.

FIELD OF THE INVENTION

The present invention relates to spill resistant containers and more especially to unitary integral single-structure non-destructively inseparable spill resistant bubble solution containers.

BACKGROUND OF THE INVENTION

Ever since the commercialization of the spill proof bubble solution container invention disclosed in the Schramm U.S. Pat. No. 5,246,046 patent, spill proof bubble solution containers have been widely popular, have become a standard in the industry and have provided autonomy and enjoyment for young children in creating bubbles without the mess that otherwise occurs when using conventional bubble creation devices. Examples of such containers are disclosed in the following patents and applications, all of which are expressly incorporated herein by reference: U.S. Pat. Nos. 7,524,230, 7,244,161, 6,857,928, 6,638,131, 6,629,870, 6,595,822, 6,520,822, 6,386,138, 6,186,853, 6,135,842, 6,015,327, 5,908,057, 5,832,969, 5,495,876, 5,304,085, 5,246,046, 5,105,975, 5,088,950, 4,957,464, 4,840,597, 4,180,938, 3,579,898, 2,858,639, RE42,610, RE39,443, RE36,131, 20110081821, 20080289975, 20050130552, 20040084453, 20030155364, 20020187716, 20020129763, 20010035413, 61/088,722, 12/539,803, and EU0094532.

Over the years, many different embodiments of the spill proof bubble solution container have been produced by many different manufacturers. However, all such prior art spill resistant containers have suffered from a common problem, namely all such containers, while typically reusable—i.e. they can be repeatedly re-filled with bubble creation solution and re-used in creating bubbles—typically require the user to disassemble the container, pour bubble solution into the container usually to a noted predetermined level (or in one case pour bubble solution out of the container), and reassemble the container prior to use. It is this disassembly, pouring, filling, and reassembly that is the source of much spilling and reduces the autonomy of the user (typically a child who is typically dependent on an adult to disassemble, pour, fill, and reassemble the container). In at least one instance of the prior art, the container does not require disassembly, but in this instance, the funnel opening is of such a small size, that pouring bubble solution into the funnel opening without spilling is extremely difficult. A product table (corresponding to the Non-Patent Literature included in the information disclosure statement filed with this application) has been prepared to provide information on known production spill resistant bubble solution containers. The table includes the respective method of use of the container.

Two known prior art containers are particularly noteworthy examples of the problems with the state-of-the-art product. In a first instance, the "Spill Proof Tweety Bubble Necklace" (NPL C15), in a design aspect atypical from of spill resistant containers, is of non-disassemblable multiple-piece construction, with the only opening of the container being the funnel opening. Thus it is through the funnel opening that bubble solution must be poured in order to use the container. The funnel opening is extremely small rendering the product extremely difficult to fill without spilling. In a second instance, the "No Spill Miracle Bubbles" (NPL C18), is provided with a "full" container of bubble solution (a conventional bottle of bubble solution) and a "No Spill Cap". In order to use the product, the user must first pour out at least half of the bubble solution from the bottle into some other (not provided) container. Not only is the pouring process highly prone to spilling, but while the user is using the product the extra bubble solution is stored in some "other" container which itself may be highly susceptible to spillage, including by the user as the user is using the product.

PRODUCT TABLE

| Product | Company | NPL | Method of Preparation |
|---|---|---|---|
| No-Spill Bubble Tumbler | Little Kids | C1 | Unscrew lid from cup. Pour solution into cup. |
| No-Spill Bubble Tumbler Mini | Little Kids | C2 | Unscrew lid from cup. Pour solution into cup. |
| No-Spill Bubble Tumbler Micro Mini | Little Kids | C3 | Unscrew lid from cup. Pour solution into cup. |
| No-Spill Big Bubble Bucket | Little Kids | C4 | Unscrew lid from cup. Pour solution into cup. |
| No-Spill Mini Bubble Bucket | Little Kids | C5 | Unscrew lid from cup. Pour solution into cup. |
| No-Spill Bubble Mug | Little Kids | C6 | Unscrew lid from cup. Pour solution into cup. |
| Cowboy Bubble Shooter and No-Spill Bubble Holster | Little Kids | C7 | Pour solution into (non-disassemblable multiple-piece construction) holster. |
| No-Spill Motorized Dip 'N Blow Bubbles | Little Kids | C8 | Pour solution into (disassemblable) dip tray. |
| No-Spill Bubble Dooods | Little Kids | C9 | Unscrew lid from cup. Pour solution into cup. |
| Spill Proof Mr. Bubbles | Strombecker | C10 | Unscrew funnel from container. Pour solution into container. |
| Spill Proof Bubble Rocket | Strombecker | C11 | Unscrew funnel from container. Pour solution into container. |
| Spill Proof Elmo's Bubble Fun | Strombecker | C12 | Unscrew lid from cup. Pour solution into cup. |
| Spill Proof Marvin The Martian Bubble Spaceship | Strombecker | C13 | Unscrew funnel from container. Pour solution into container. |
| Spill Proof Hunny Pot | Strombecker | C14 | Unscrew funnel from container. Pour solution into container. |
| Spill Proof Tweety Bubble Necklace | Strombecker | C15 | Pour solution into (non-disassemblable multiple-piece construction) container. |
| Spill Proof Container with Auxiliary Handle | Strombecker | C16 | Unscrew lid from cup. Pour solution into cup. |

-continued

PRODUCT TABLE

| Product | Company | NPL | Method of Preparation |
|---|---|---|---|
| Mini Spill Proof | Strombecker | C17 | Unscrew lid from cup. Pour solution into cup. |
| No Spill Miracle Bubbles | Imperial Toy | C18 | Unscrew funnel from bottle. Pour solution into (or out of) bottle. |
| No Spill Bubble Submarine | Imperial Toy | C19 | Unscrew funnel from container. Pour solution into container. |
| No Spill Bubble Cell Phone | Imperial Toy | C20 | Remove plug from container. Pour solution into (small) opening in container. |
| No Tip No Spill Tumbler | Tmnpria1 Toy | C21 | Unscrew funnel from container. Pour solution into container. |
| No Spill Bubbles 'N Sand Bucket | Imperial Toy | C22 | Unscrew lid from cup Pour solution into cup. |
| Spill Stopper | Imperial Toy | C23 | Unscrew lid from bottle. Screw spill stopper lid to bottle. |
| No Spill Bubble Buddy | Little Tykes | C24 | Unscrew lid from cup. Pour solution into cup. |
| No Spill Bubble Bucket | Little Tykes | C25 | Unscrew lid from cup. Pour solution into cup. |
| SuperNon-Spill Double Tumbler | Placo | C26 | Unscrew lid from cup. Pour solution into cup. |
| Pivot Top Spill Resistant Bubbles | Placo | C27 | Unscrew lid from cup. Pour solution into cup. |
| Spill Resistant Giant Bucket | Placo | C28 | Unscrew lid from cup. Pour solution into cup. |
| Spill Resistant (Mini) Bucket | Placo | C29 | Unscrew lid from cup. Pour solution into cup. |
| Never Spill Bubbles | Tanget Toy (ToySmith) | C30 | Unscrew lid from (multiple-piece) container. Pour solution into container. |
| Non Spill Bubble Tumbler | Battat | C31 | Unscrew funnel from container. Pour solution into container. |
| No Spill Tumbler | Flair/Funrise | C32 | Unscrew lid from cup. Pour solution into cup. |
| (Non Spill) Bubble Bouncer | Funrise | C33 | Unscrew lid from cup. Pour solution into cup. |
| Bubble Wubble Tumbler | Funrise | C34 | Unscrew lid from cup. Pour solution into cup. |
| Weeble Wobble Bubble Bottle | Koosh/OddzOn | C35 | Unscrew lid from cup. Pour solution into cup. |
| No-Spill Canteen (Bubble Explorer) | Toys R Us | C36 | Unscrew funnel from container. Pour solution into container. |
| Barbie Baubles 'N bubbles Bubble Purse | Toy Quest | C37 | Unsnap top from bottom. Pour solution into bottom. |

SUMMARY OF THE INVENTION

The present invention is a spill resistant container apparatus that eliminates the need for spill prone pouring of liquid such as bubble solution. The apparatus preferably includes a single member spill resistant container having a neck and an impending funnel, a bubble creation device, a frangible seal, a lid, and bubble creation solution. The bubble creation device and bubble creation solution, are preferably sealingly contained within the container by the frangible seal and the lid is preferably threadingly and removably attached to the neck of the container. No pouring or filling of bubble creation solution is required for a user in using the apparatus to creating bubbles. In order to use the apparatus in creating bubbles, one need only threadingly remove the lid, tear open the frangible seal, remove the bubble creation device, and blow a bubble. From the point of purchase of the apparatus until the bubble creation solution of the apparatus is consumed, there is never an occasion wherein the container needs to be disassembled or reassembled, and thus there is never an opportunity for gross spillage of the bubble creation solution. By avoiding the disassembly, assembly, and pouring required of the prior art, in contrast to the prior art, there is never a point wherein the instant spill resistant container apparatus invention is rendered non-spill-resistant.

DESCRIPTION OF DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are included to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

In order to facilitate the understanding of the present invention in reviewing the drawings accompanying the specification, a feature table is provided below. It is noted that like features are like numbered throughout all of the figures.

FEATURE TABLE

| # | Feature |
|---|---|
| 10 | Spill resistant container apparatus |
| 20 | Spill resistant container |
| 22 | Container side |
| 24 | Container bottom |
| 26 | Container floor |
| 28 | Container stand |
| 30 | Container trough |
| 32 | Container top |
| 34 | Container neck |
| 36 | Container threads |
| 38 | Container seal surface |
| 40 | Container bowl |

-continued

FEATURE TABLE

| # | Feature |
|---|---|
| 42 | Container opening |
| 44 | Container funnel |
| 46 | Funnel upper opening |
| 48 | Funnel lower opening |
| 60 | Bubble creation wand |
| 62 | Wand handle |
| 64 | Wand stem |
| 66 | Wand ring |
| 70 | Seal |
| 80 | Lid |
| 82 | Lid top |
| 84 | Lid flange |
| 86 | Lid threads |
| 90 | Bubble creation solution |
| 120 | Spill resistant container pre-form |
| 146 | Container pre-form funnel |

Figure 8:
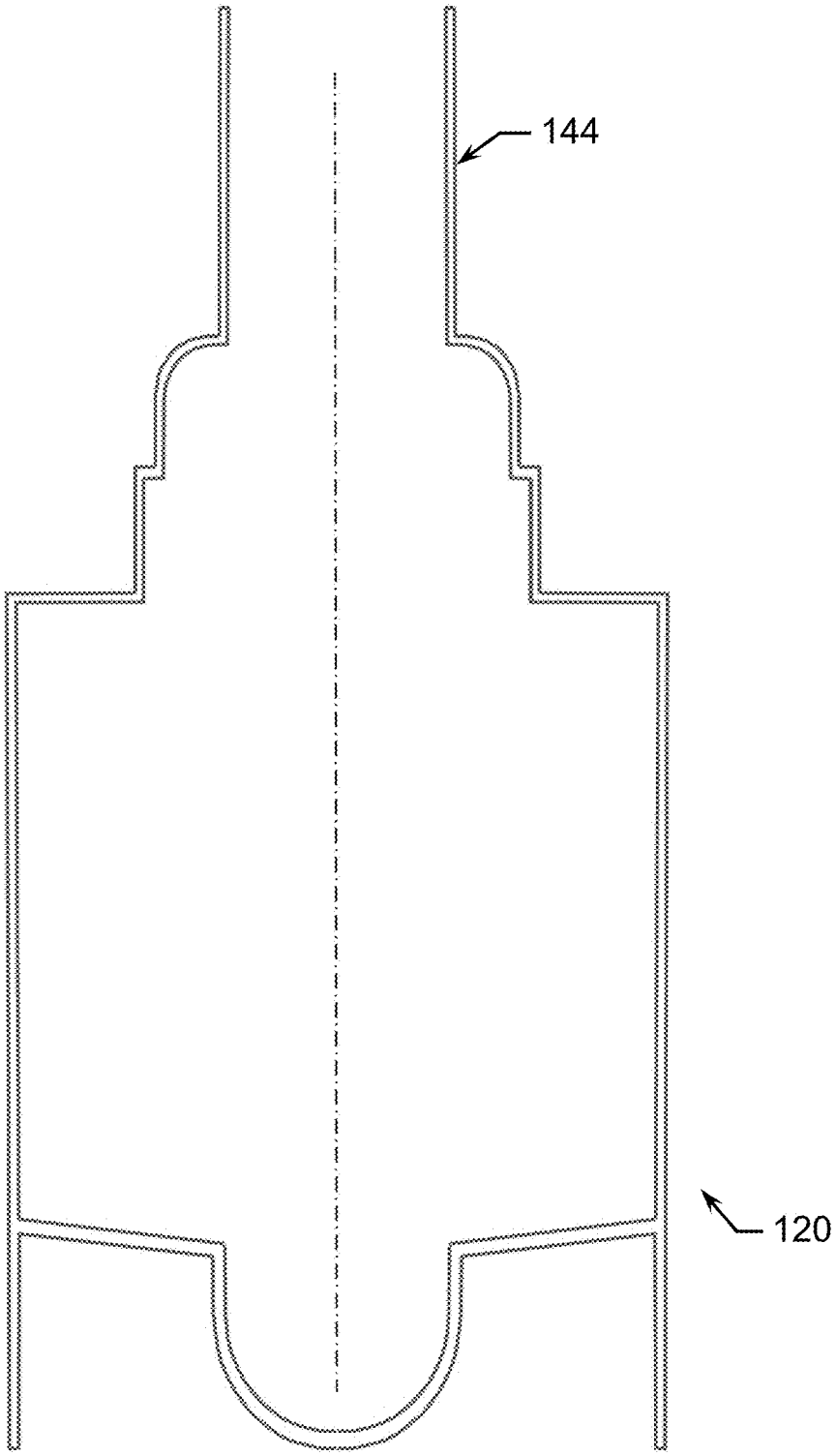
FIG. 8 is an orthographic side section view a pre-form of the spill resistant container taken substantially at the location of section arrows 8 shown in FIG. 1 and is shown in a partially molded stage with the funnel protruding externally from the cavity of the spill resistant container.

Referring now to the drawings, and in particular to FIGS. 1 through 7, the first embodiment of the invention is a spill resistant container apparatus 10 for use in creating bubbles without the otherwise attendant spillage of bubble solution resulting in pouring bubble solution into or out of the apparatus comprising a spill resistant container 20, a bubble creation wand 60, a seal 70, a lid 80, and bubble creation solution 90. Spill resistant container 20 defines a generally cylindrical shaped preferably one-piece plastic container defining an inner cavity and having a side portion 22, a bottom portion 24, a floor 26, a stand 28, a trough 30, a top portion 32, a neck 34, threads 36, a seal faying surface 38, a bowl 40, a container opening 42, a funnel 44, a funnel upper opening 46, and a funnel lower opening 48. Spill resistant container 20 preferably defines a liquid tight container such that liquid contained within spill resistant container 20 may not run, leak or seep out of spill resistant container 20 except that liquid may enter or exit through opening 42. Funnel 44 preferably extends approximately to (funnel lower opening 48 is located approximately at) the volumetric and geometric center of spill resistant container 20 so as to provide a container having a spill resistant capacity (the capacity of liquid that will not run out of the container regardless of the orientation of the container) that approaches one-half of the overall capacity of spill resistant container 20. Spill resistant container 20 is preferably constructed so as to be of significantly low cost and preferably disposable after the bubble solution that is provided seal within spill resistant container 20 is consumed. More particularly, spill resistant container 20 preferably defines a blow molded plastic container. It is noted that blow molding is a process used to economically create plastic, typically hollow parts of generally uniform wall thickness, by extruding a unit of molten plastic, termed a parison, onto a nozzle and then blowing air through the nozzle and into the parison to cause the parison to expand and to form to the shape of a mold cavity such as is taught in appendix A which is incorporated herein in its entirety. Given the potential challenge of blow molding spill resistant container 20 (having an impending funnel 44) in a single step, spill resistant container 20 is optionally molded by first blow molding spill resistant container pre-form 120 which is substantially similar to spill resistant container 20 but instead of inwardly extending funnel 44, spill resistant container pre-form 120 includes an externally extending funnel 146 as shown in FIG. 8. In a secondary step, external funnel 146 is inverted into the inner cavity of spill resistant container pre-form 120 to result in spill resistant container 20. Bubble creation wand 60 defines a generally elongated wand preferably plastic injection molded wand having a handle 62, a stem 64, and at least one bubble ring 66. Bubble ring 66 preferably includes a plurality of fins extending from bubble ring 66 to increase the surface area of bubble ring 66 resulting in an increased bubble solution retention capacity. Seal 70 preferably defines an adhesively bondable disk shaped frangible metal foil seal but alternately may be of other shapes and may be of other seal material such as a non-metal seal. Seal 70 preferably includes a tab portion that may be grasped in order to break open or peel open seal 70. Lid 80 preferably defines conventional generally cylindrically shaped injection molded plastic lid having a top 82, a flange 84, and threads 86. Bubble creation solution 90 defines a conventional liquid bubble creation solution such as a glycerin based liquid bubble creation solution.

Figure 1:
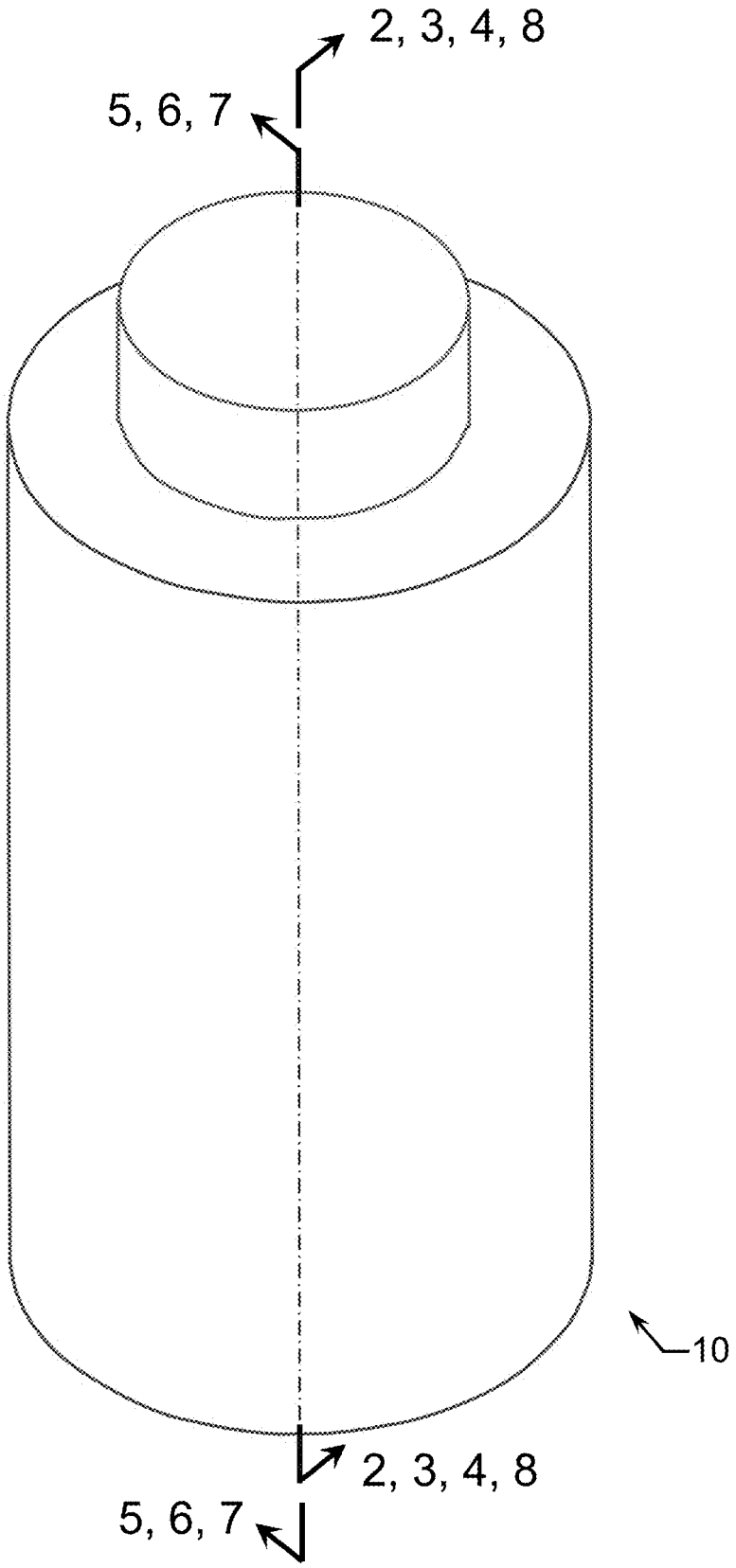
FIG. 1 is an isometric view of a first embodiment of the spill resistant container apparatus.
Figure 2:
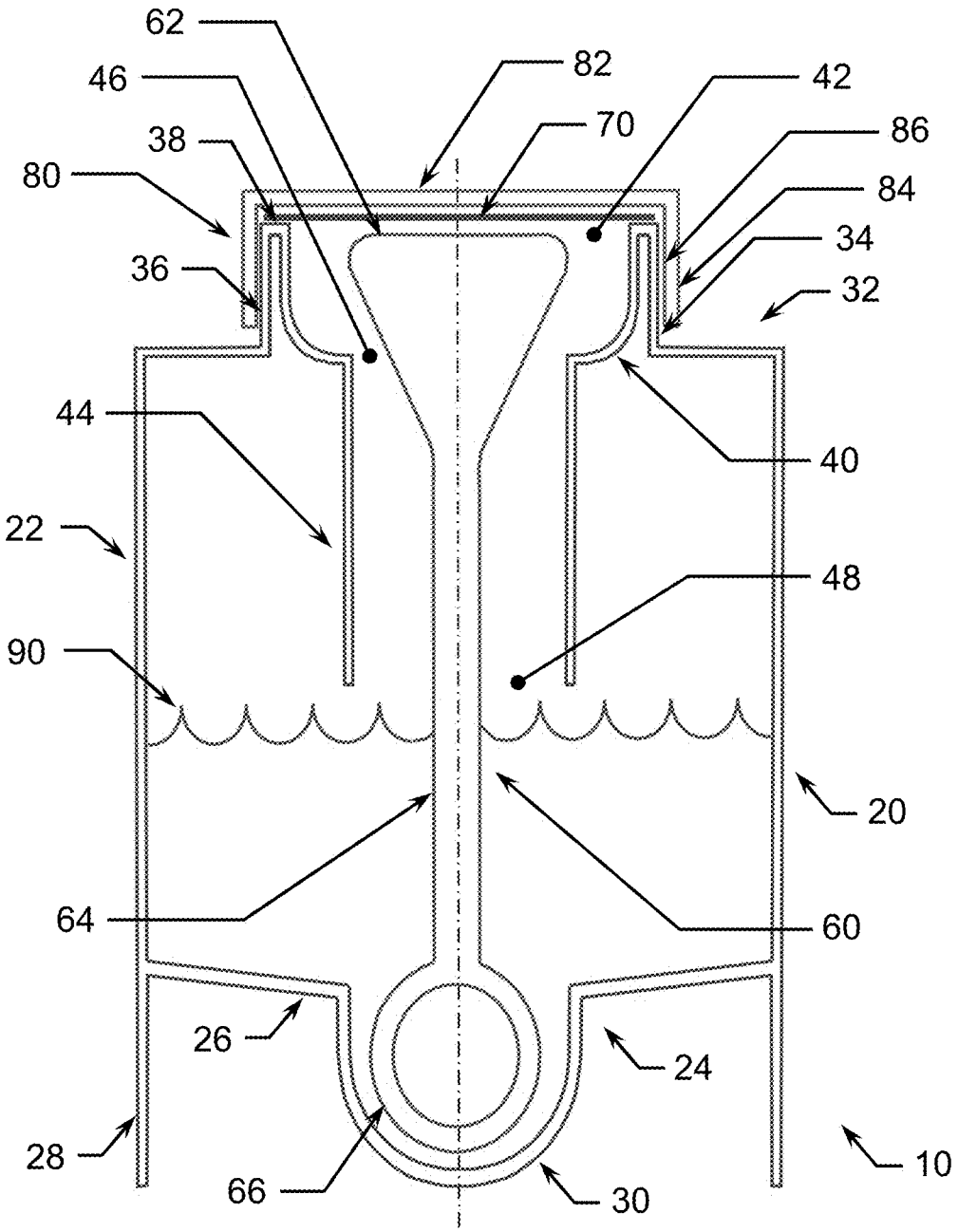
FIG. 2 is an orthographic side section view a first embodiment of the spill resistant container apparatus taken substantially at the location of section arrows 2 shown in FIG. 1 and is shown in a pre-opened configuration with the bubble creation solution and bubble creation device sealed within the container and the lid threaded onto the container, and with the apparatus in an upright orientation with bubble solution shown positioned in the trough and bottom portion of the container.
Figure 3:
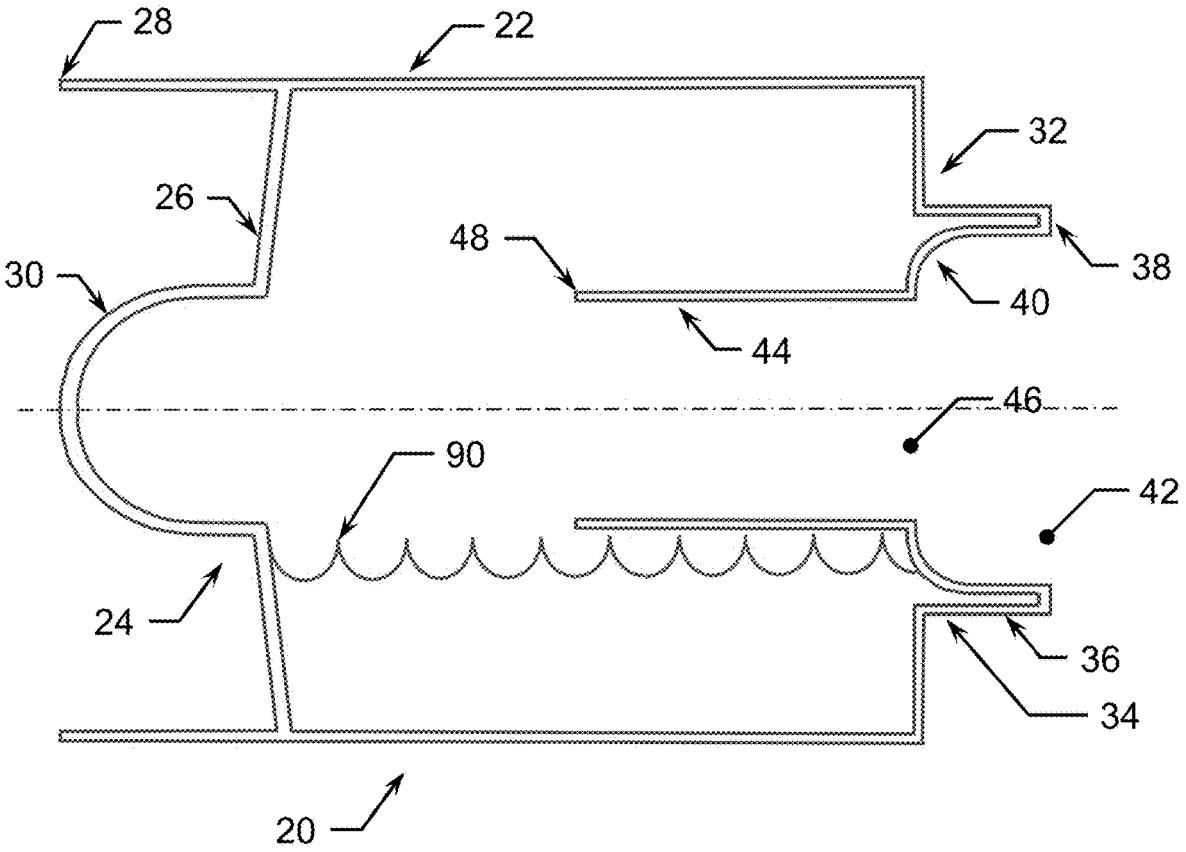
FIG. 3 is substantially identical to FIG. 2 except that in FIG. 3 the spill resistant container apparatus is shown in a post-opened configuration without the bubble creation device, seal, and lid, and with the apparatus shown in a sideways orientation with bubble creation solution shown positioned a side portion of the container.
Figure 4:
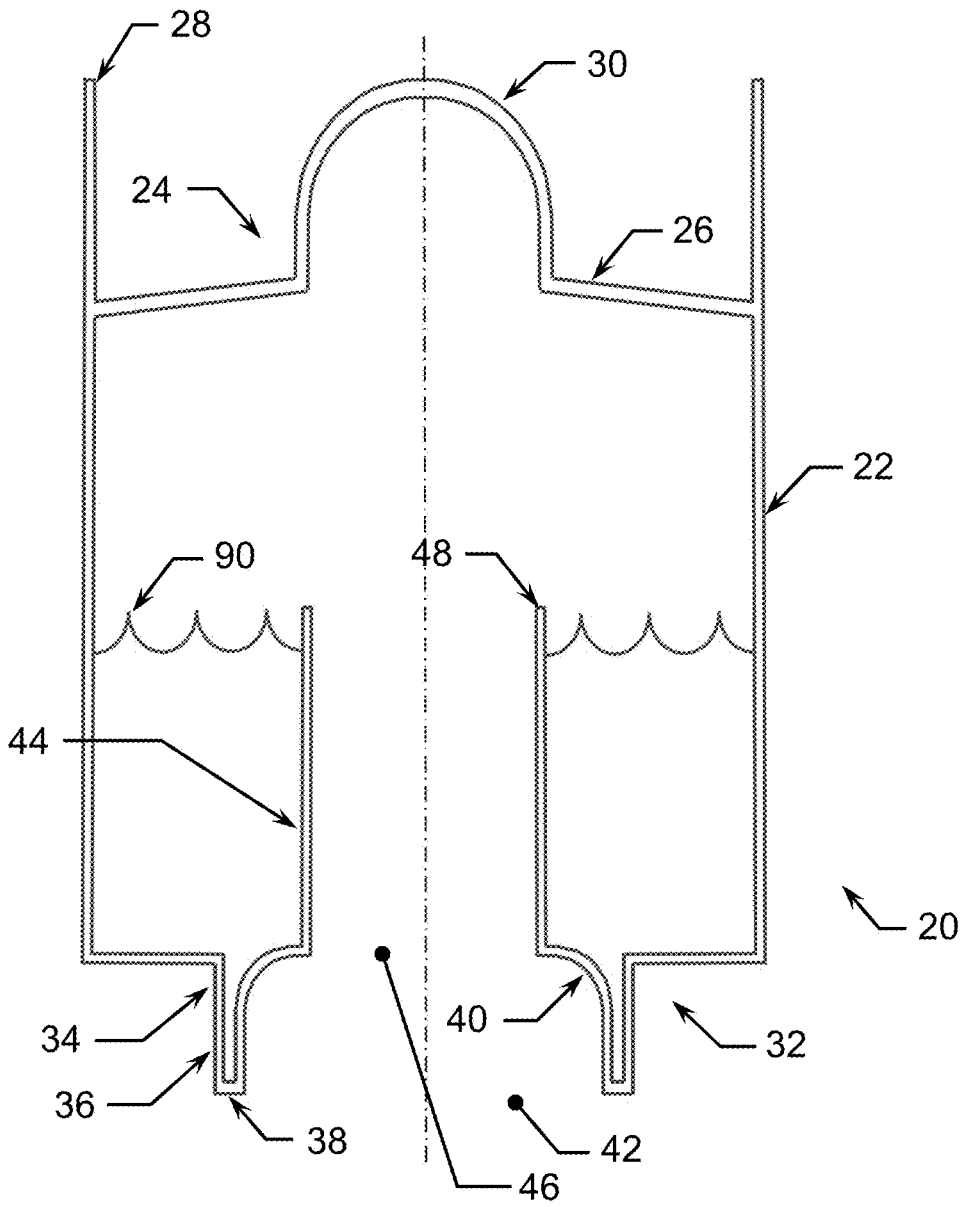
FIG. 4 is substantially identical to FIG. 2 except that in FIG. 4 the spill resistant container apparatus is shown in a post-opened configuration without the bubble creation device, seal, and lid, and with the apparatus shown in an upside-down orientation with bubble creation solution shown positioned in the top portion of the container.
Figure 5:
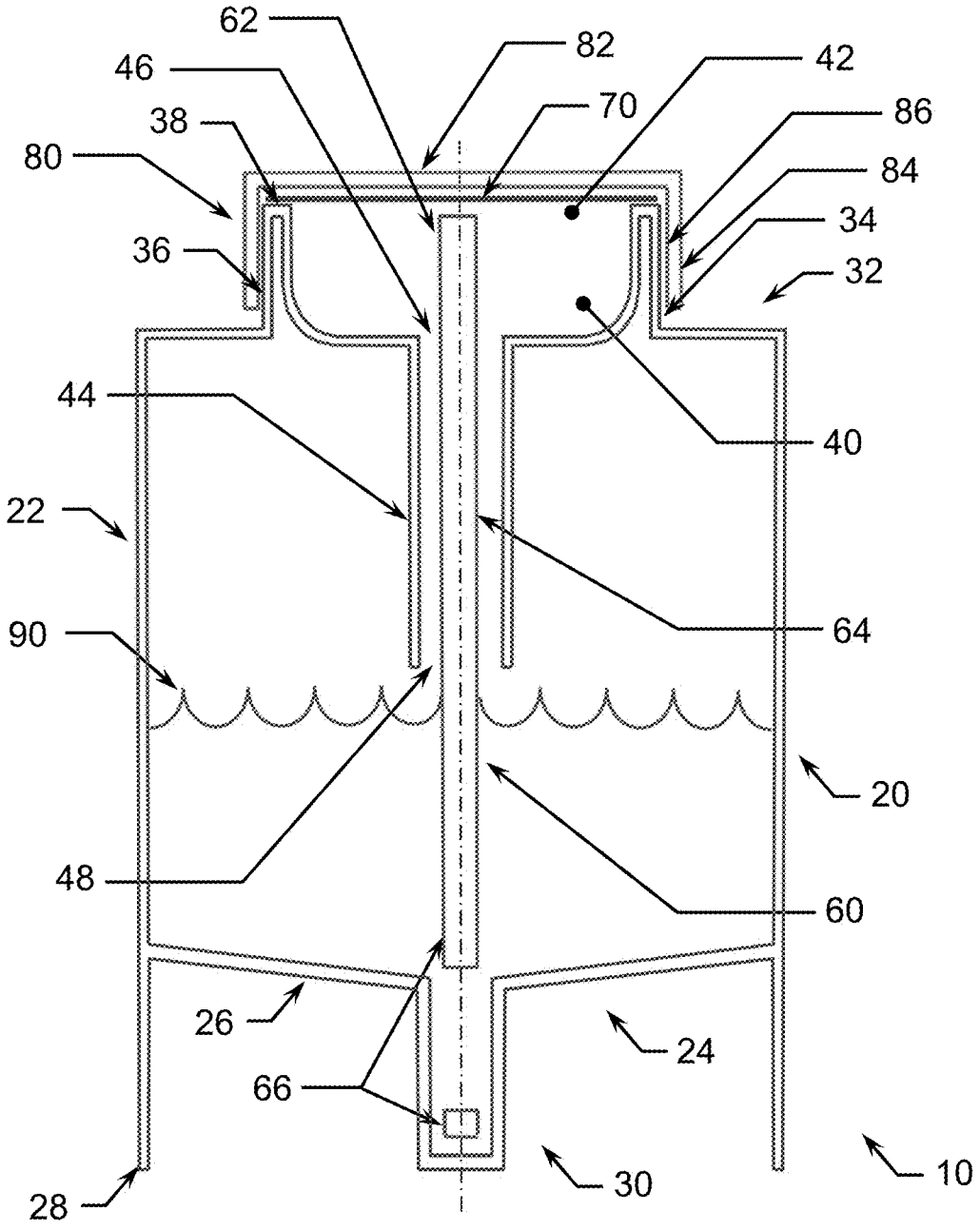
FIG. 5 is an orthographic side section view a first embodiment of the spill resistant container apparatus taken substantially at the location of section arrows 5 shown in FIG. 1 and is shown in a pre-opened configuration with the bubble creation solution and bubble creation device sealed within the container and the lid threaded onto the container, and with the apparatus in an upright orientation with bubble solution shown positioned in the trough and bottom portion of the container.
Figure 6:
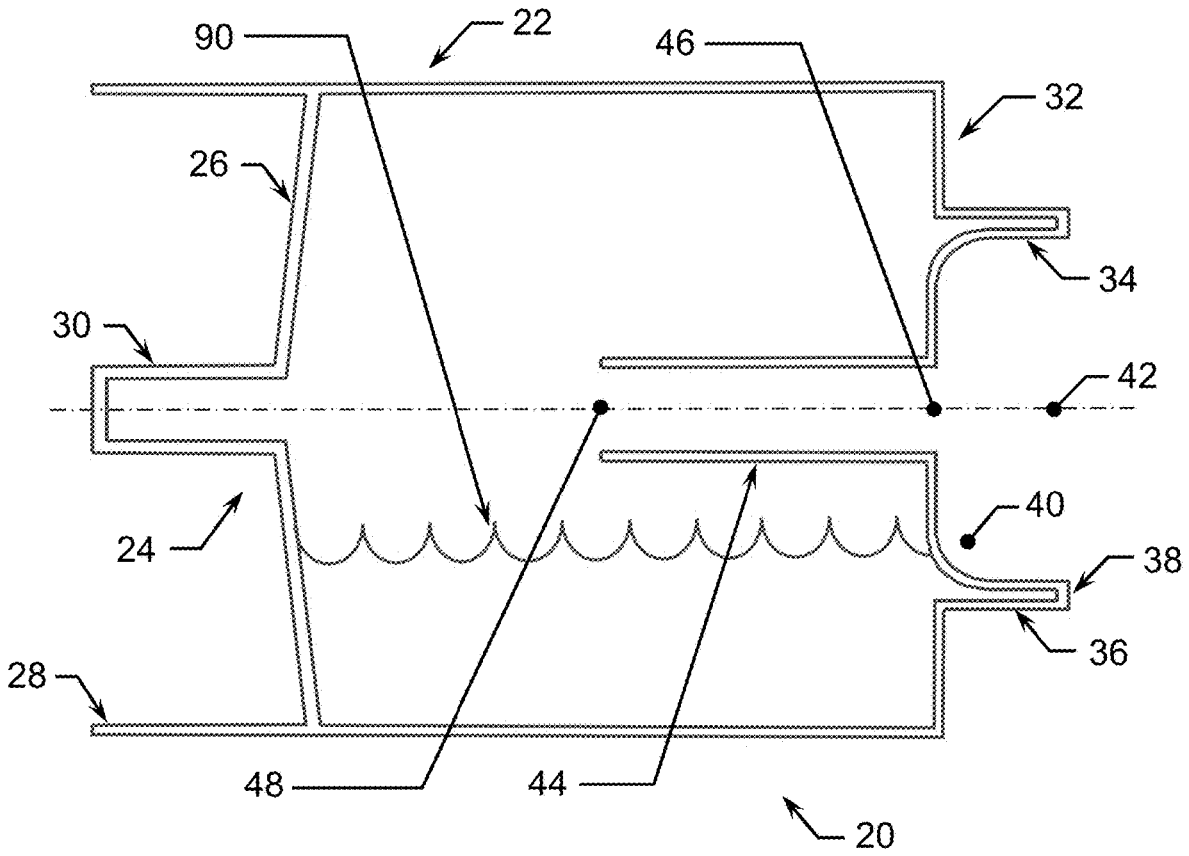
FIG. 6 is substantially identical to FIG. 5 except that in FIG. 6 the spill resistant container apparatus is shown in a post-opened configuration without the bubble creation device, seal, and lid, and with the apparatus shown in a sideways orientation with bubble creation solution shown positioned a side portion of the container.
Figure 7:
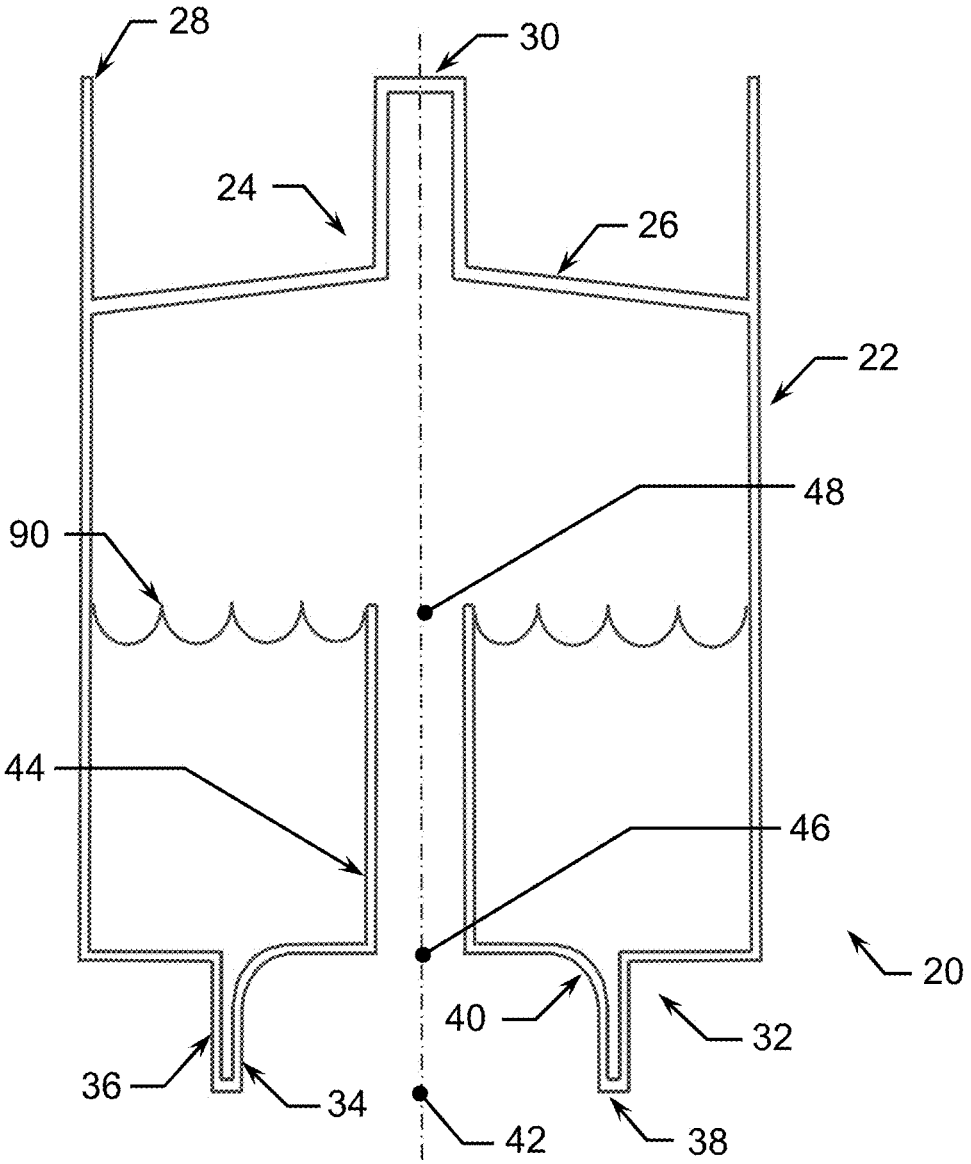
FIG. 7 is substantially identical to FIG. 5 except that in FIG. 7 the spill resistant container apparatus is shown in a post-opened configuration without the bubble creation device, seal, and lid, and with the apparatus shown in an upside-down orientation with bubble creation solution shown positioned in the top portion of the container.

Spill resistant container apparatus 10 is assembled by adding a predetermined quantity of bubble creation solution 90 (preferably a quantity such that bubble creation solution 90 will not run out of spill resistant container 20 regardless of the spatial orientation of spill resistant container 20) such as by metering the predetermined quantity of bubble creation solution 90 into spill resistant container 20 via a fill nozzle connected to a filling machine. Bubble creation wand 60 is then placed into spill resistant container 20 by inserting bubble creation wand 60 through opening 42 and into funnel 44 preferably such that bubble creation wand 60 does not extend beyond an outer surface of spill resistant container 20 substantially as shown in FIGS. 2 and 5. Seal 70 is then sealingly attached to spill resistant container 20 by adhesively bonding seal 70 to seal surface 38 such that the combination of spill resistant container 20 and bonded seal 70 preferably form a substantially hermetically sealed container assembly. Lid 80 is threadingly connected to spill resistant container 20 by engaging threads 86 and threads 36 and by rotating or screwing lid 80 onto neck 34 of spill resistant container 20.

In practice, spill resistant container apparatus 10 is purchased as defined above with bubble creation solution 90 sealingly contained within spill resistant container 20. A user, such as a young child, detaches lid 80 from spill resistant container 20 by unscrewing lid 80 from neck 34 of spill resistant container 20. The user then breaks seal 70 and withdraws bubble creation wand 60, which is charged with bubble creation solution 90, from spill resistant container 20 by placing the users fingers within bowl 40, grasping handle 62, and pulling bubble creation wand 60 out of funnel 44. The user then creates bubbles by blowing into wand ring 66. Once bubble creation solution 90 is consumed from bubble creation wand 60, bubble creation wand 60 is again inserted into spill resistant container 20 by moving bubble creation wand 60 through funnel 44. The bubble creation process is then repeated until the user tires of creating bubbles or until bubble creation solution 90 contained within spill resistant container 20 is consumed. If bubble creation solution 90 contained within spill resistant container 20 is not consumed but the user tires of creating bubbles, lid 80 is replaced onto spill resistant container 20 so as to prevent debris ingress and evaporation and spill resistant container apparatus 10 is stored for subsequent use. If bubble creation solution 90 previously contained within spill resistant container 20 is consumed, the user merely discards spill resistant container apparatus 10. It is noted that spill resistant container 20 will prevent spillage of bubble creation solution 90 regardless of the orientation in which spill resistant container 20 may be positioned. It is further noted that short of destructively altering spill resistant container 20, the user is prevent from ever pouring bubble creation solution 90 out of spill resistant container 20, and that the user need never pour bubble creation solution into or out of spill resistant container 20 in order to use spill resistant container apparatus 10, thus furthering the spill resistant utility of spill resistant container apparatus 10.

In an alternate embodiment of the spill resistant container apparatus, the spill resistant container apparatus is substantially identical to spill resistant container apparatus 10 except that rather than having the one-piece structure of spill resistant container 20, the alternate spill resistant container apparatus includes a spill resistant container having a multi-piece structure. Such multi-piece structure preferably defines a spill resistant container comprising a liquid-tight bonded assembly of non-destructively inseparable discrete pieces (i.e. as opposed to the prior art which typically includes at least a separable cup portion and funnel portion, the discrete pieces may not be separated or opened without permanently or destructively altering the spill resistant container).

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A container having an inner cavity and a piston-free funnel extending into said inner cavity, wherein said container having a piston-free funnel defines a single non-assembly discrete integral structural member, and wherein said container includes a frangible seal adhered to said container so as to substantially seal said inner cavity from the exterior of said container.

2. The container of claim 1, wherein said piston-free funnel is open and provides communication between said inner cavity and the exterior of said container, and wherein when said container contains a non-gaseous fluid and is oriented in any orientation, at least a portion of said non-gaseous fluid is prevented from running out of said container.

3. The container of claim 1, wherein said container contains at least one of a quantity of bubble creation solution and a bubble creation device.

4. The container of claim 1, wherein said container contains a quantity of bubble creation solution and a bubble creation device.

5. The container of claim 1, wherein said container further defines at least one of a container that includes a bottom having a generally disked shaped trough formed therein, and a container wherein a cross-section of said piston-free funnel defines a substantially rectangular shaped cross-section.

6. The container of claim 1, wherein said container further defines at least one of a container adapted such that bubble creation solution may be spill resistantly accessed within said container without initially disassembling or assembling said container and a container adapted such that bubble creation solution may be spill resistantly accessed within said container without initially pouring bubble solution into or out of said container.

7. A container having an inner cavity and at least one piston-free opening providing communication between said inner cavity and the exterior of said container, wherein said container is adapted such that when said container contains a non-gaseous fluid and is oriented in any orientation, at least a portion of said non-gaseous fluid is prevented from running out of said container, and wherein said container having at least one piston-free opening defines a single non-assembly discrete integral structural member, and wherein said container includes a frangible seal adhered to said container so as to substantially seal said inner cavity from the exterior of said container.

8. The container of claim 7, wherein said container contains at least one of a quantity of bubble creation solution and a bubble creation device.

9. The container of claim 7, wherein said container contains a quantity of bubble creation solution and a bubble creation device.

10. The container of claim 7, wherein said container further defines at least one of a container that includes a bottom having a generally disked shaped trough formed therein, and a container having a funnel extending into said inner cavity wherein a cross-section of said funnel defines a substantially rectangular shaped cross-section.

11. The container of claim 7, wherein said container includes a funnel extending into said inner cavity.

12. The container of claim 7, wherein said container further defines at least one of a container adapted such that bubble creation solution may be spill resistantly accessed within said container without initially disassembling or assembling said container and a container adapted such that bubble creation solution may be spill resistantly accessed within said container without initially pouring bubble solution into or out of said container.

13. A container apparatus comprising a container having a seal adhered thereto such that at least one of a bubble creation device and bubble creation solution is substantially watertightly sealed within said container, wherein said container includes an inner cavity and a piston-free funnel extending into said inner cavity.

14. The container apparatus of claim 13, wherein said piston-free funnel is open and provides communication between said inner cavity and the exterior of said container, and wherein when said container contains a non-gaseous fluid and is oriented in any orientation, at least a portion of said non-gaseous fluid is prevented from running out of said container.

15. The container apparatus of claim 13, wherein said seal defines a frangible seal adhered to said container so as to substantially hermetically seal said inner cavity from the exterior of said container.

16. The container apparatus of claim 13, wherein said container defines at least one of a single non-assembly discrete integral structural member container and a non-destructively inseparable container.

17. The container apparatus of claim 13, wherein said container further defines at least one of a container that includes a bottom having a generally disked shaped trough formed therein, and a container wherein a cross-section of said piston-free funnel defines a substantially rectangular shaped cross-section.

18. The container apparatus of claim 13, wherein said container further defines at least one of a container adapted such that bubble creation solution may be spill resistantly accessed within said container without initially disassembling or assembling said container and a container adapted such that bubble creation solution may be spill resistantly accessed within said container without initially pouring bubble solution into or out of said container.

19. A container having an inner cavity and at least one piston-free opening to provide communication between said inner cavity and the exterior of said container, wherein said at least one piston-free opening includes a frangible seal sealingly connected thereto, and wherein said container is adapted such that said container inner cavity is sealed substantially watertight from the exterior of said container, and such that when said container contains a non-gaseous fluid and is oriented in any orientation and said frangible seal is broken, said non-gaseous fluid is prevented from running out of said container.

20. The container of claim 19, wherein said container defines at least one of a single non-assembly discrete integral structural member container and a non-destructively inseparable container.

21. The container of claim 19, wherein said container further defines at least one of a container that includes a bottom having a generally disked shaped trough formed therein, and a container having a funnel extending into said inner cavity wherein a cross-section of said funnel defines a substantially rectangular shaped cross-section.

22. The container of claim 19, wherein said container includes a funnel extending into said inner cavity.

23. The container of claim 19, wherein said container further defines at least one of a container adapted such that bubble creation solution may be spill resistantly accessed within said container without initially disassembling or assembling said container and a container adapted such that bubble creation solution may be spill resistantly accessed within said container without initially pouring bubble solution into or out of said container.

24. The container of claim 19, wherein said container contains at least one of a quantity of bubble creation solution and a bubble creation device.

25. A container apparatus comprising a container having an inner cavity and a piston-free funnel extending into said inner cavity and an unobstructedly accessible bubble creation device removably contained at least partially within said container, wherein said bubble creation device does not extend beyond an outer surface of said container.

26. The container apparatus of claim 25, wherein said piston-free funnel is open and provides communication between said inner cavity and the exterior of said container, and wherein when said container contains a non-gaseous fluid and is oriented in any orientation, at least a portion of said non-gaseous fluid is prevented from running out of said container.

27. The container apparatus of claim 25, wherein said container contains a quantity of bubble creation solution.

28. The container apparatus of claim 25, wherein said container includes a frangible seal adhered to said container so as to substantially seal said inner cavity from the exterior of said container.

29. The container apparatus of claim 25, wherein said container further defines at least one of a container that includes a bottom having a generally disked shaped trough formed therein, and a container wherein a cross-section of said piston-free funnel defines a substantially rectangular shaped cross-section.

30. The container apparatus of claim 25, wherein said container further defines at least one of a container adapted such that bubble creation solution may be spill resistantly accessed within said container without initially disassembling or assembling said container and a container adapted such that bubble creation solution may be spill resistantly accessed within said container without initially pouring bubble solution into or out of said container.

31. The container apparatus of claim 25, wherein said container defines at least one of a single non-assembly discrete integral structural member container and a non-destructively inseparable container.

32. A container apparatus comprising a container having an inner cavity and a piston-free funnel extending into said inner cavity and a bubble creation device and bubble creation solution substantially hermetically sealed within said container.

33. The container apparatus of claim 32, wherein when said apparatus is unsealed, said bubble creation device and said bubble creation solution are accessible but said bubble creation solution is prevented from running out of said container regardless of the orientation of said container.

34. The container apparatus of claim 32, wherein said bubble creation device defines a bubble creation wand having at least one bubble ring.

35. The container apparatus of claim 32, wherein said container further defines at least one of a container adapted such that bubble creation solution may be spill resistantly accessed within said container without initially disassembling or assembling said container and a container adapted such that bubble creation solution may be spill resistantly accessed within said container without initially pouring bubble solution into or out of said container.

36. A container apparatus comprising a container having an inner cavity and a piston-free opening to provide communication between said inner cavity and the exterior of said container, a bubble creation device, bubble creation solution, and a frangible seal, wherein said frangible seal is affixed to said container such that said bubble creation device and said bubble creation solution are substantially hermetically sealed within said container, and wherein said apparatus is adapted such that when said frangible seal is broken or removed, said bubble creation device and said bubble creation solution are accessible but said bubble creation solution is prevented from running out of said container regardless of the orientation of said container.

37. The container apparatus of claim 36, wherein said bubble creation device defines a bubble creation wand having at least one bubble ring, and wherein when said frangible seal is broken or removed, said bubble creation device is readily removable from said container.

38. The container apparatus of claim 36, wherein said container includes a funnel extending into said inner cavity.

39. The container apparatus of claim 36, wherein said container further defines at least one of a container adapted such that bubble creation solution may be spill resistantly accessed within said container without initially disassembling or assembling said container and a container adapted such that bubble creation solution may be spill resistantly accessed within said container without initially pouring bubble solution into or out of said container.

* * * * *